US005188053A

United States Patent [19]

Gjestrum et al.

[11] Patent Number: 5,188,053

[45] Date of Patent: Feb. 23, 1993

[54] ARRANGEMENT IN A BUOYANCY TOWED BODY MEANS

[75] Inventors: Einar Gjestrum, Baerum Verk; Oddbjørn Hjelle, Sjoholt; Øyvind Hogsnes, Hof; Gunnar F. Valle, Stavanger; Øyvind Sørbotten, Haugesund, all of Norway

[73] Assignee: Geco A.S., Stavanger, Norway

[21] Appl. No.: 564,067

[22] Filed: Aug. 8, 1990

[30] Foreign Application Priority Data

Aug. 10, 1989 [NO] Norway ..... 893225

[51] Int. Cl.[5] ..... B63B 21/56

[52] U.S. Cl. ..... 114/242; 114/253

[58] Field of Search ..... 114/244, 248, 245, 246, 114/253, 352; 441/133; 367/15, 131, 141

[56] References Cited

U.S. PATENT DOCUMENTS

| | | | |
|---|---|---|---|
| 2,397,958 | 4/1946 | Freeman | 114/244 X |
| 2,798,211 | 7/1957 | Smith | 367/154 X |
| 3,144,848 | 8/1964 | Knott et al. | 114/244 X |
| 3,327,968 | 6/1967 | Converse | 114/244 X |
| 3,478,711 | 11/1969 | Combs | 114/244 X |
| 3,839,985 | 10/1974 | Modert | 114/253 X |
| 4,227,476 | 10/1980 | Park et al. | 114/244 X |

*Primary Examiner*—Edwin L. Swinehart

*Attorney, Agent, or Firm*—Jacobson, Price, Holman & Stern

[57] ABSTRACT

A bouyancy towed body, especially to be used in marine seismic surveys is assembled from a plurality of modules (1, 2, 3, 4) for adaption to various applications. Modules (1–4) may be locked together, e.g. by through rods (6) provided with tensioning screw and nut devices (8). Modules (1–4) are assembled to form a buoyancy member having a homogeneous surface shape. One (3) or a plurality of modules may be provided with elements (5) for attaching desired equipment thereto which may hang down from the towed body.

14 Claims, 2 Drawing Sheets

ARRANGEMENT IN A BUOYANCY TOWED BODY MEANS

BACKGROUND OF THE INVENTION

The invention relates to an arrangement in a buoyancy towed body means, especially to be used in seismic surveys.

Buoyancy means to be towed at sea should be designed in different sizes or shapes, dependent on their application, to function in the best possible manner. When such buoyancy tow means are towed, e.g. in marine seismic surveys, they generally carry different kinds of equipment, e.g. seismic sources of energy, hydrophones, etc. which hang down under the buoyancy means, or the buoyancy means is connected with an otter board device to guide towed means outwards laterally relative to the towing vessel. Buoyancy means may also be utilized as a front divider of long, if desired, flexible buoyancy means from which seismic equipment is suspended.

With all these mentioned applications and depending on the equipment which is suspended from the buoyancy means, different sizes will be required, which means that seismic vessels have to carry different sizes of such means which form a bulky and unhandy load.

Efforts have been made to remedy this situation by collapsing the buoyancy means when they are not operative but this will, in turn, require cumbersome inflating, and still, buoyancy means of suitable sizes must be carried in a suitable assortment.

BRIEF SUMMARY OF THE INVENTION

It is an object of the invention to provide buoyancy means which are designed to avoid such problems and which permit a buoyancy means to be readily assembled, so that buoyancy means for all kinds of applications are available, at the same time as a minimum number of buoyancy means are carried on the vessel although it is still possible to provide buoyancy means for any situation that might possibly arise.

This object is achieved by a buoyancy means described hereinafter.

By designing a buoyancy means to comprise a plurality of separate buoyancy modules, each of which has its shape adapted for assemblage to a homogeneous body, it is possible to adjust the buoyancy of the body to be adapted to various applications and various load capacities, simply by varying the number of modules which are assembled into a unit. In this manner it will be possible to provide elements which are especially adapted for carrying special equipment, to design central sections providing particular buoyancy, and to utilize modules, e.g. with guide fins, etc. for special applications. The design of a buoyancy means in the shape of modules, thus, provides for very high flexibility, and only a minimum of buoyancy members have to be carried on the vessel, at the same time as the modules are smaller than complete buoyancy means and can, thus, more readily be stowed away when not in use. A very high degree of flexibility is, thus, achieved. Each buoyancy means comprises at least one head member and one tail member, but said end modules may also be specially adapted. The tail module may, e.g. be designed to form a connecting unit for an elongated buoyancy member to be used for long seismic towed means.

One or a plurality of the modules are preferably designed with grooves, e.g. peripheral grooves, in which various kinds of equipment may be secured, e.g. rope devices or electronic emitter receiver equipment, or separate sources of seismic energy may be suspended from them. Some modules may also be provided with radar reflectors or the like, if such equipment is needed in the towed means.

The modules are preferably connected by the lid of a centrally arranged rod, which is passed through all modules and which may be provided with a plate member at one end and a tensioning nut at the other end. Members to be towed may also be secured to such a rod.

BRIEF DESCRIPTION OF THE DRAWINGS

The invention will now be described in detail with reference to embodiments shown in the accompanying drawing, wherein.

DETAILED DESCRIPTION

Figure 1:
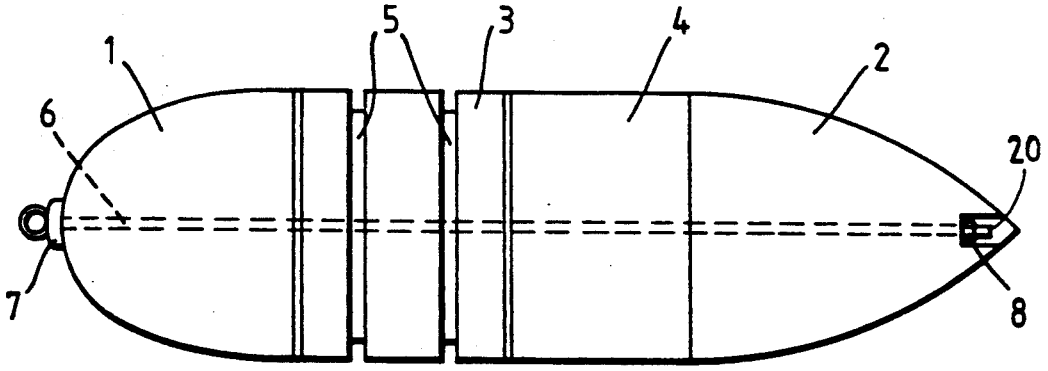
FIG. 1 is an elevational view of one embodiment of a module assembly of buoyancy means according to the invention.

In FIG. 1 of the drawing a buoyancy means is shown to be comprised of four modules. Modules 1 and 2 constitute the head module, and the tail module, respectively, of the complete buoyancy means. Between said two modules further two modules 3 and 4 are provided, of which module 3 is provided with grooves 5 for attachment of equipment. In the drawing dashed lines indicate a connecting rod 6 with a plate shaped member 7 in front, and a tensioning screw thread and nut means 8 at the opposite end in a recess 20 of said member. In this manner the modules may readily be connected. The connection is discussed in more detail in connection with FIG. 4.

Figure 2:
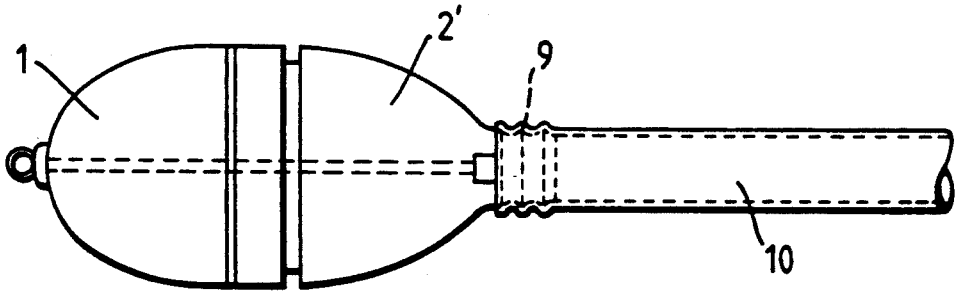
FIG. 2 is a view similar to FIG. 1 of a second embodiment.

FIG. 2 shows another embodiment of a buoyancy means, in which both intermediate modules 3 and 4 are omitted and said means only comprises a head module 1 and a tail module 2'. Tail module 2' is in the shown embodiment provided with an end piece 9 which is provided with grooves and is intended for connection with an elongated, hose-shaped buoyancy means 10, which may have considerable length and constitutes the buoyancy means for a series of sources of seismic energy, or of a seismic streamer cable.

Figure 3:
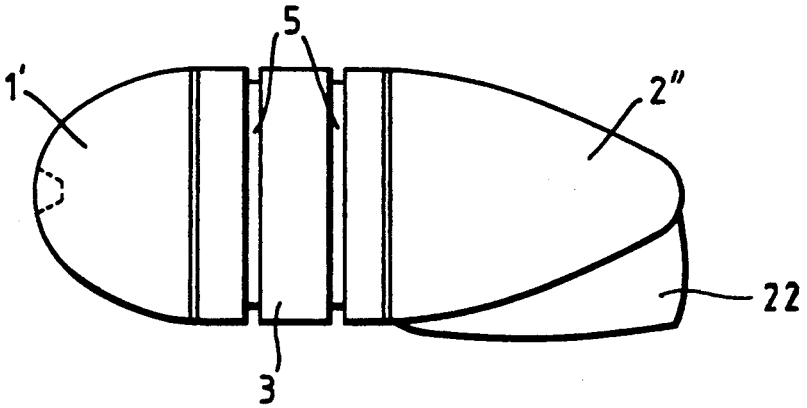
FIG. 3 is a view similar to FIG. 1 of a third embodiment.

FIG. 3 shows a third possible assembly, in which one head module 1' is followed by an intermediate module 3' with grooves 5, and a tail module 2'', on which a guide fin 22 is firmly mounted. Alternatively, radar reflectors or the like may be mounted on the assembly.

Figure 4A:
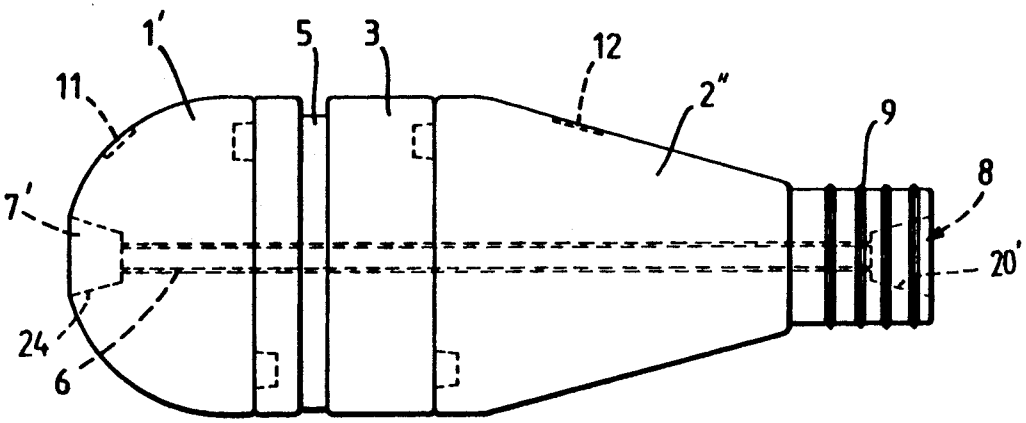
FIG. 4 is an elevational view of another embodiment of a buoyancy means according to the invention.
FIG. 4B is an end view of the embodiment of FIG. 4A from the left end thereof.
FIG. 4C is a partial cross-sectional view of the embodiment of FIG. 4A.
Figure 4B:
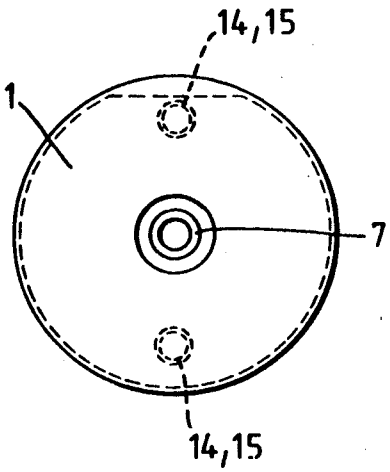
Figure 4C:
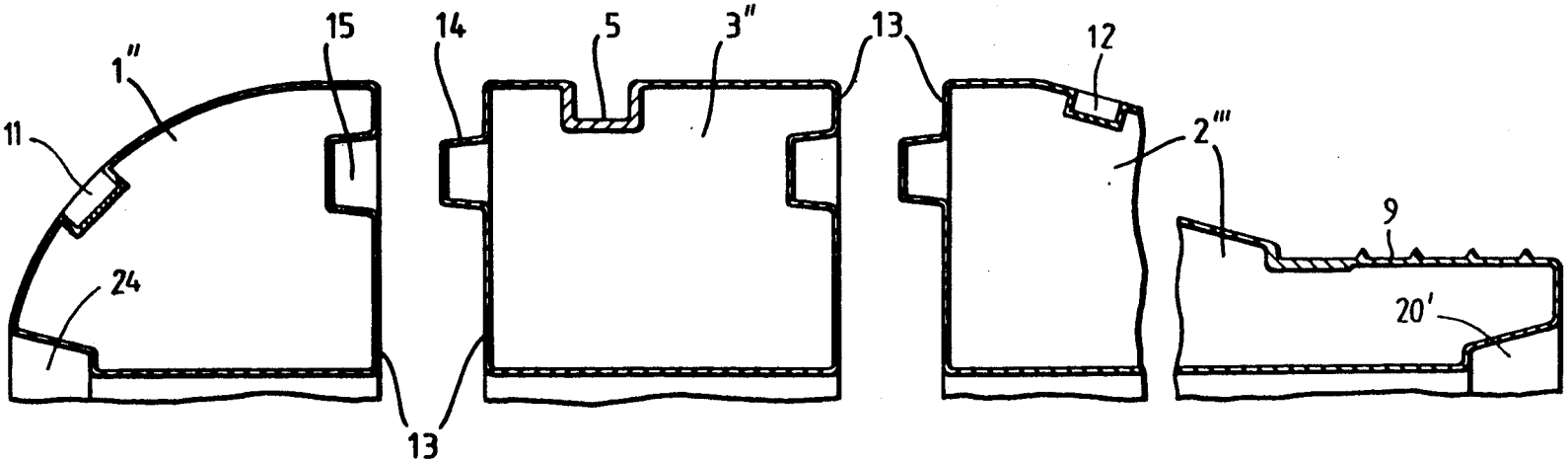

FIGS. 4A, 4B and 4C are respectively; one elevational view, one left end view, and a longitudinal cross-section through an upper half of a practical embodiment of a buoyancy means according to the invention. In these figures the same reference numerals are used as those used in the remaining figures for corresponding parts. The shown embodiment is intended for being provided with an elongated hose-shaped buoyancy means which is secured over grooves 9 in the same manner as indicated in FIG. 2. Connecting member 6 ends in the shape of an end sleeve 7' which is inserted in a recess 24 in head module 1'. At the other end a tensioning member similar to 8 in FIG. 1 may be provided in a manner not shown, in a recess 29' in tail module 2''. In addition to what is shown in the other figures, FIG. 4C also shows an advantageous embodiment of the connection of respective module members 1'', 2'' and 3''. In order to align said members correctly relative to each other, abutting end faces of modules, which are all designated 13 in the figure, are provided with lug-like and recess-like members 14, and 15, respectively. The last mentioned members may, e.g. be provided diametrically opposed, as illustrated in FIG. 4B. Lug-members 14 are adapted to be inserted into recesses 15. Upon insertion of lugs 14 into recesses 15 in at least two places the modules will be non-displaceably connected with each other and they will be correctly aligned relative to each other upon connection by the aid of rod means 6.

Many modifications will be possible within the scope of the invention. It will, thus, be possible to use other methods of connecting than a central rod, e.g. by the aid of tensioning wires or clamping means. Suspension of additional equipment may also be achieved in some other manner than by the aid of grooves 5. Furthermore, mutual alignment of modules may also be achieved in some other manner than by lugs recesses. Those skilled in the Art will readily be able to carry out such modifications. On the surface of the buoyancy means various desired means may also be provided, Which may e.g. be incorporated in the surface, e.g. radar reflectors or reflecting areas, as indicated at 11, and identification fields, as indicated at 12, etc.

We claim:

1. In a towed buoyant body towed in the sea by a vessel and used as a buoyancy body for supporting marine seismic survey equipment, the improvement comprising:

at least two buoyant modules comprising a head module and a tail module;

at least one end face on each module for mutually abutting relationship with an end face on an adjacent module;

retaining means for releasably retaining said modules together end-to-end with said end faces of adjacent modules in mutually abutting relationship in assembled position to form a unitary buoyant body, said modules being shaped so that said unitary buoyant body has a homogeneous smooth outer surface;

protruding means protruding from one of each of said mutually abutting end faces of adjacent modules;

recess means in the other of each of said mutually abutting end faces of said adjacent modules for receiving respective protruding means in said assembled position to prevent relative rotation between said modules; and supporting means in at least one of said modules for supporting sad survey equipment.

2. A towed buoyant body as claimed in claim 1 wherein said at least two buoyant modules further comprise:

at least one intermediate module disposed between said head and tail modules and having opposite ends; and end faces on said opposite ends of said at least one intermediate module for mutually abutting relationship with end faces of adjacent modules;

said protruding means and recess means being provided on respective end faces of said at least one intermediate module.

3. A towed buoyant body as claimed in claim 1 wherein said retaining means comprises:

aligned apertures through said modules;

retaining rod means extending through said apertures; and tensioning means an one end of said rod means for tensioning said rod means.

4. A towed buoyant body as claimed in claim 2 wherein said retaining means comprises:

aligned apertures through said modules;

retaining rod means extending though said apertures; and tensioning means an one end of said rod means for tensioning said rod means.

5. A towed buoyant body as claimed in claim 1 wherein:

said supporting means comprises at least one peripheral groove for engaging with a fastening means attached to said equipment.

6. A towed buoyant body as claimed in claim 2 wherein:

said supporting means comprises at least one peripheral groove for engaging with a fastening means attached to said equipment.

7. A towed buoyant body as claimed in claim 3 wherein:

said supporting means comprises at least one peripheral groove for engaging with a fastening means attached to said equipment.

8. A towed buoyant body as claimed in claim 3 wherein:

said supporting means comprises at least one peripheral groove for engaging with a fastening means attached to said equipment.

9. A towed buoyant body as claimed in claim 1 and further comprising:

guide fin means on said tail module.

10. A towed buoyant body as claimed in claim 1 and further comprising:

at least one radar reflector on at least one of said modules.

11. A towed buoyant body as claimed in claim 8 and further comprising:

guide fin means on said tail module.

12. A towed buoyant body as claimed in claim 8 and further comprising:

at least one radar reflector on at least one of said modules.

13. A towed buoyant body as claimed in claim 1 and further comprising:

an externally grooved end sleeve on the rear end of said tail modules to facilitate connection with a separate elongated buoyant member.

14. A towed buoyant body as claimed in claim 8 and further comprising:

an externally grooved end sleeve on the rear end of said tail modules to facilitate connection with a separate elongated buoyant member.

* * * * *